US007834825B2

(12) United States Patent
Mizukoshi et al.

(10) Patent No.: US 7,834,825 B2
(45) Date of Patent: Nov. 16, 2010

(54) ORGANIC ELECTROLUMINESCENT DISPLAY APPARATUS

(75) Inventors: Seiichi Mizukoshi, Kanagawa (JP); Nobuyuki Mori, Saitama (JP); Kouichi Onomura, Yokohama (JP); Makoto Kohno, Yokohama (JP)

(73) Assignee: Global OLED Technology LLC, Wilmington, DE (US)

( * ) Notice: Subject to any disclaimer, the term of this patent is extended or adjusted under 35 U.S.C. 154(b) by 990 days.

(21) Appl. No.: 10/599,029

(22) PCT Filed: Mar. 17, 2005

(86) PCT No.: PCT/US2005/009028

§ 371 (c)(1),
(2), (4) Date: Sep. 18, 2006

(87) PCT Pub. No.: WO2005/101360

PCT Pub. Date: Oct. 27, 2005

(65) Prior Publication Data

US 2007/0210996 A1 Sep. 13, 2007

(30) Foreign Application Priority Data

Mar. 30, 2004 (JP) ..... 2004-101143

(51) Int. Cl.
*G09G 3/30* (2006.01)

(52) U.S. Cl. ..... 345/77; 345/76; 345/690

(58) Field of Classification Search ..... 345/76, 345/77, 690

See application file for complete search history.

(56) References Cited

U.S. PATENT DOCUMENTS

| | | | | |
|---|---|---|---|---|
| 5,886,474 | A * | 3/1999 | Asai et al. | 315/169.1 |
| 6,501,230 | B1 * | 12/2002 | Feldman | 315/169.3 |
| 6,677,958 | B2 | 1/2004 | Cottone et al. | 345/589 |
| 7,088,052 | B2 | 8/2006 | Kimura | 315/169.2 |
| 2001/0024186 | A1 * | 9/2001 | Kane et al. | 345/98 |
| 2003/0122813 | A1 | 7/2003 | Ishizuki et al. | |
| 2003/0234754 | A1 * | 12/2003 | Abe et al. | 345/76 |
| 2004/0041756 | A1 * | 3/2004 | Henmi et al. | 345/76 |

FOREIGN PATENT DOCUMENTS

| | | |
|---|---|---|
| EP | 0 905 673 A1 | 3/1999 |
| EP | 1424672 | 6/2004 |
| JP | 11-219146 | 8/1999 |
| JP | 2003-150099 | 5/2003 |
| JP | 2003-195813 | 7/2003 |

* cited by examiner

*Primary Examiner*—Amare Mengistu
*Assistant Examiner*—Koosha Sharifi
(74) *Attorney, Agent, or Firm*—Morgan Lewis & Bockius LLP

(57) ABSTRACT

An organic EL display apparatus including in each display pixel an organic EL element. A drive transistor supplies a drive current that depends on brightness data and having the display pixels arranged in a matrix form. The display includes a correction gain storage unit for storing display pixel positions and a correction gain for correcting the slope of the brightness-data-based drive current of the drive transistors in the display pixels; and a correction unit for correcting pixel-by-pixel brightness data depending on the pixel position using the correction gain stored in the correction gain storage unit into brightness data for the pixel to generate corrected brightness data, each of the display pixels is displayed by driving its drive transistor in response to the data generated by the correction gain storage unit and the correction unit and supplying the corresponding organic EL element with the drive current.

6 Claims, 6 Drawing Sheets

ORGANIC ELECTROLUMINESCENT DISPLAY APPARATUS

FIELD OF THE INVENTION

The present invention relates generally to an organic EL display apparatus in which display pixels including organic EL elements are arranged in a matrix form, and more particularly to correction of brightness non-uniformity in the display pixels.

BACKGROUND OF THE INVENTION

FIG. 1 shows an example configuration of a circuit for one pixel (pixel circuit) in an active organic EL display apparatus. With the source connected to a power line PVdd, a P channel drive TFT 1 has the drain connected to the anode of an organic EL element 3, whereas the organic EL element 3 has its cathode connected to a cathode power supply CV. The source of an N channel selection TFT 2 is connected to the gate of the drive TFT 1, whereas the selection TFT 2 has its drain connected to a data line Data with the gate connected to a gate line Gate. One end of a holding capacitor C is connected to the gate of the drive TFT 1, whereas the other end of the capacitor C is connected to a capacitor power supply line Vsc.

Therefore, a data signal is stored in the holding capacitor C by pulling up the horizontally extending gate line to H level, turning on the selection TFT 2 and under these conditions applying a data signal having a voltage appropriate to the display brightness to the vertically extending data line Data. This allows the drive TFT 1 to supply the organic EL element 3 with a drive current appropriate to the data signal, resulting in the organic EL element 3 emitting light.

In this case, light emission amount and current of the organic EL element are roughly proportional to each other. Normally, a voltage (Vth) is applied between the gate of the drive TFT 1 and PVdd such that a drain current begins to flow near the image black level. As for image signal amplitude, an amplitude is applied such that a given brightness is available near the white level.

FIG. 2 shows the relationship between input signal voltage of the drive TFT 1 (gate-source voltage Vgs=difference between the voltage of the data line Data and the power supply PVdd) and a current icv (corresponding to brightness) flowing through the organic EL element 3. It is possible to perform proper gradation control in the organic EL element 3 by determining a data signal such that Vth is applied as black level voltage and Va as white level voltage.

In this case, the organic EL display apparatus is configured by a display panel in which a number of pixels are arranged in a matrix form. For this reason, Vth varies from one pixel to another due to manufacturing problems, occasionally resulting in a pixel-to-pixel variation of optimal black level in a single display panel. This gives rise to an uneven light emission amount relative to data the signal (input voltage), resulting in uneven brightness.

For this reason, correction is proposed in which each pixel brightness is measured and the black level voltage is corrected for each of all pixels according to correction data stored in memory (Japanese Patent Application Laid-Open Publication No. 1999-282420).

As shown in FIG. 3, however, the pixel drive TFT may present a variation of not only Vth (ΔVth) but also V-I slope (gm). That is, a mean pixel characteristic in line n (b) differs from a mean characteristic of all pixels (a) not only in Vth by ΔVth but also in slope of the drive current icv with respect to the input voltage, with the difference between the characteristics (a) and (b) not being uniform at input voltages Va1, Va2 and Va3. In such a case, correction of Vth alone does not allow for sufficient correction.

SUMMARY OF THE INVENTION

It is therefore an object of the present invention to compensate for the current characteristic of drive transistors relative to brightness data.

In order to achieve the above object, according to a major aspect of the present invention there is provided an organic EL display apparatus including in each display pixel an organic EL element and a drive transistor that supplies the organic EL element with a drive current that depends on brightness data and having the display pixels arranged in a matrix form, the organic EL display apparatus comprising a correction gain storage unit for storing display pixel positions and a correction gain for correcting the slope of the brightness-data-based drive current of the drive transistors in the display pixels; and a correction unit for correcting pixel-by-pixel brightness data depending on the pixel position using the correction gain stored in the correction gain storage unit into brightness data for the pixel to generate corrected brightness data, wherein each of the display pixels is displayed by driving the drive transistor based on corrected brightness data generated by the correction unit and supplying the corresponding organic EL element with the drive current.

Preferably, the correction unit multiplies brightness data by a correction gain. The organic EL display apparatus may further comprise a correction offset storage unit for storing a display pixel position and a correction offset for correcting an offset for brightness data of the drive transistor in the display pixel for each area consisting of a given plurality of display pixels, wherein the correction unit corrects pixel-by-pixel brightness data depending on the pixel position using the correction gain stored in the correction gain storage unit and the correction offset stored in the correction offset storage unit into brightness data for the pixel to generate corrected brightness data. Preferably, the correction unit adds the correction offset to or subtracts the offset from the brightness data. The correction gain storage unit may store a correction value for each of horizontal or vertical lines.

The organic EL display apparatus may further comprise overall emission control means for allowing all display pixels in a display area, in which the display pixels are arranged in a matrix form, to emit light based on two or more items of brightness data that are different from one another; selective emission control means for allowing organic EL elements of a plurality of display pixels within the given area in the display area to selectively emit light based on two or more items of brightness data that are different from one another; current detection means for detecting individual drive currents when all and selected pixels emit light; and slope characteristic calculation means for calculating, in relation to a slope of drive current with respect to brightness data in a display pixel selected based on the detected drive current, the relationship of the slope of the drive current with respect to the brightness data for all display pixels, wherein a correction gain corresponding to a slope characteristic calculated by the slope characteristic calculation means is stored in the correction gain storage unit.

The organic EL display apparatus preferably further comprises offset characteristic calculation means for calculating, in relation to a drive current offset with respect to brightness data in a display pixel selected based on the detected drive current, the relationship of the drive current offset with respect to the brightness data for all display pixels, wherein a correction offset corresponding to an offset characteristic calculated by the offset characteristic calculation means is stored in the correction offset storage unit.

According to the present invention, it is possible to compensate for variations of the V-I characteristic slope (gm) of the pixel drive TFT, thus keeping light emission even and appropriate.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE PREFERRED EMBODIMENTS

Embodiments of the present invention will be described hereinbelow with reference to the accompanying drawings.

Figure 4:
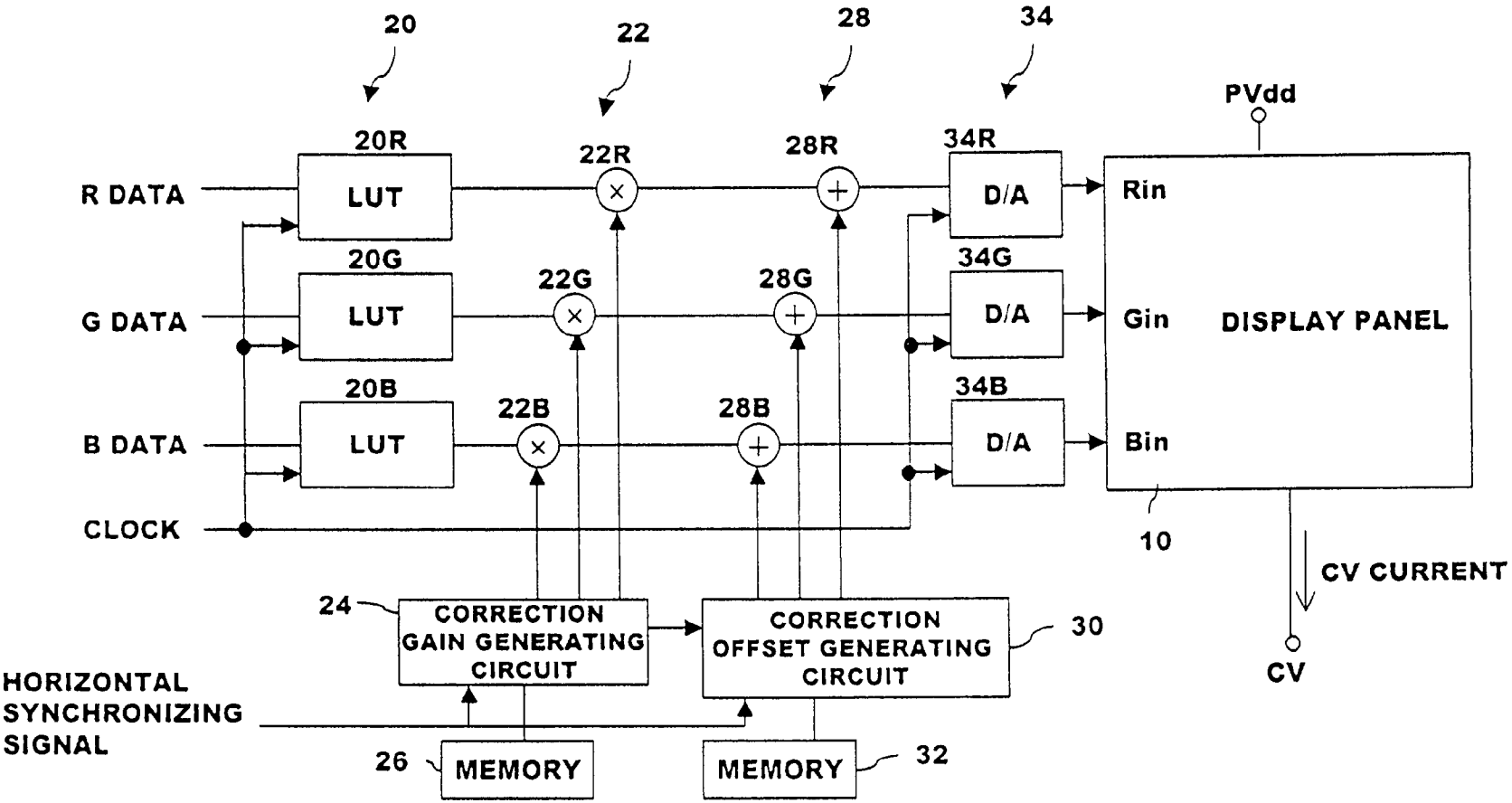
FIG. 4 is a block diagram showing the configuration of the EL display apparatus for performing correction with correction gain and offset.

FIG. 4 shows a configuration for creating corrected brightness data (analog signal) to be supplied to a display panel from brightness data in the organic EL display apparatus of the present invention.

A display panel 10 has pixels for each of the RGB colors, with brightness data to be displayed being input separately for each of the RGB colors. For example, pixels of the same color are arranged vertically, thus allowing each data line to be supplied with data of one of RGB and individual colors to be displayed. It is to be noted that each item of RGB data is eight-bit brightness data in this example.

R, G and B data is supplied respectively to lookup tables LUT20R, LUT20G and LUT20B. The lookup tables LUT20 (20R, 20G, 20B) store table data that is gamma-corrected to provide a given curve in the relationship of emission brightness (drive current) with respect to brightness data taking into consideration mean offset and gain in the display panel 10. That is, the lookup tables LUT20 store data that compensates for the characteristic (a) in FIG. 3. Therefore, brightness data conversion using the lookup tables LUT20 brings light emission amount of the organic EL element in line with brightness data when a drive TFT with a mean characteristic is driven.

It is to be noted that characteristic equations may be stored rather than the lookup tables LUT20, thus converting brightness data using calculations. It is to be noted that the output of each of the lookup tables LUT20R, LUT20G and LUT20B is expanded to 10 bits in width in this example. Meanwhile, the lookup tables LUT20R, LUT20G and LUT20B are supplied with a clock synchronous with pixel-by-pixel input data, making the outputs from the lookup tables LUT20R, LUT20G and LUT20B also synchronous with this clock.

The outputs of the lookup tables LUT20R, LUT20G and LUT20B are supplied to multipliers 22R, 22G and 22B. The multipliers 22R, 22G and 22B are each supplied with a multiplication correction value from a correction gain generating circuit 24. Connected with a memory 26, the correction gain generating circuit 24 determines, from a horizontal synchronizing signal, which horizontal line the incoming brightness data corresponds to and reads out the multiplication correction value for that horizontal line from the memory 26, thus generating the multiplication correction value.

The outputs of the multipliers 22R, 22G and 22B are supplied respectively to adders 28R, 28G and 28B. The adders 28R, 28G and 28B are supplied respectively with offset correction values from a correction offset generating circuit 30. Connected with a memory 32, the correction offset generating circuit 30 reads out the offset correction value for the horizontal line from the memory 32, thus generating the offset correction value.

The outputs of the adders 28R, 28G and 28B are supplied to D/A converters 34R, 34G and 34B for conversion to analog signals that will then be supplied to input terminals Rin, Gin and Bin of the display panel 10 for individual colors. In the display panel 10, data signals corrected for individual colors according to the pixel position are supplied to the data line, thus allowing the EL element in each pixel to be driven with a current appropriate to the data signal.

Thus, according to the present embodiment, offset and V-I characteristic compensation and gamma correction targeted for average drive TFTs are performed using the lookup tables LUT20. The correction gain generating circuit 24 and the correction offset generating circuit 30 output the correction gain and offset at each pixel position using the memories 26 and 32. Therefore, not only is the variation ΔVth of the threshold voltage Vth of the drive transistor (drive TFT) compensated for at each pixel but sp is the V-I characteristic of the drain current (organic EL drive current) with respect to the gate-source voltage Vgs, thus supplying the organic EL element with a proper drive current appropriate to the brightness data.

Although, in the present embodiment, the correction gain generating circuit 24 and the correction offset generating circuit 30 generate given correction values for each line, the present invention is not limited thereto, and an equation may be stored that prescribes a correction value for each pixel by viewing the display panel 10 as a plane. That is, correction value=ax+by+c (or coefficients a, b and c) is stored. Then, pixel positions x and y of a data signal are recognized in response to a pixel-synchronous clock, generating a corresponding correction value.

A separate correction value may be generated for each of RGB as in this example, or a common correction value may be generated for all RGB.

It is to be noted that the output correction values from the correction gain generating circuit 24 and the correction offset generating circuit 30 are 10 bits and therefore the multipliers 22R, 22G and 22B and the adders 28R, 28G and 28B are 10 bits in width.

Correction Gain and Correction Offset

As described above, in the present embodiment correction gain is stored in the memory 26 and correction offset is stored in the memory 32. For this reason, correction gain and offset will be described below.

As an example, a case is considered in which there is unevenness between horizontal lines. If a certain input voltage Va2 is applied to all pixels of the panel in which Vth and gm of the drive TFT are different between lines, a CV current varies from one line to another, resulting in striped unevenness. Brightness non-uniformity in the organic EL display panel resulting from such a manufacturing problem is compensated for by correction gain and offset.

Correction gain and offset are generated and used in correction carried out in the following manner:

i) Light up all pixels of the display panel 10 with two or more input voltages (three points, namely, Va1, Va2 and Va3 in FIG. 3 in this example) and measure the CV current at each input voltage. Measurement may be made either on the PVdd or CV side as long as total current flowing into the display panel 10 can be successfully measured.

Figure 1:
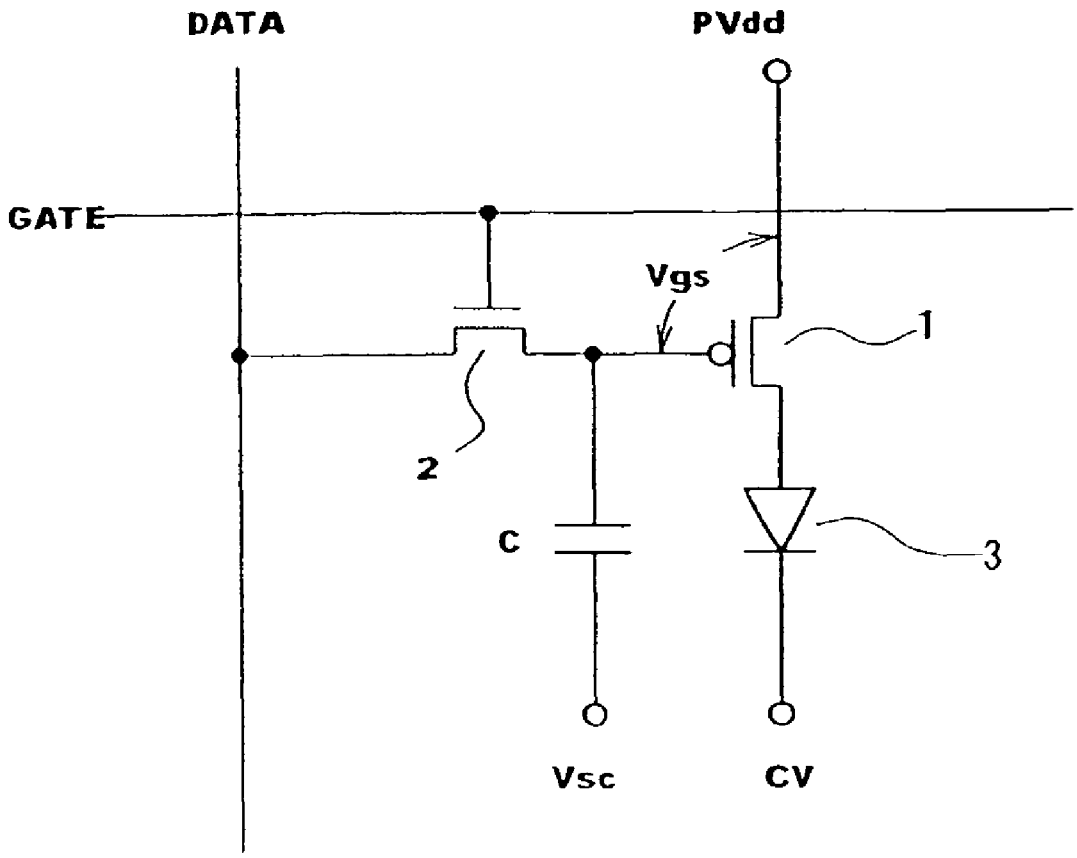
FIG. 1 is a view showing a configuration example of a pixel circuit in an active organic EL display apparatus.
Figure 2:
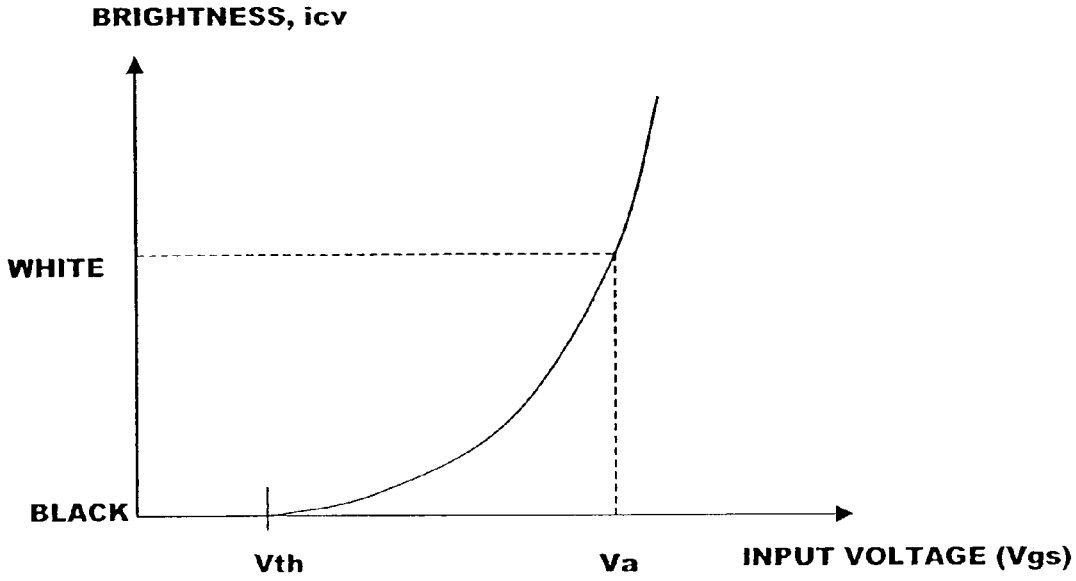
FIG. 2 is a view showing the relationship of brightness and a current icv flowing into an organic EL element with respect to a gate-source voltage Vgs of a drive TFT.
Figure 3:
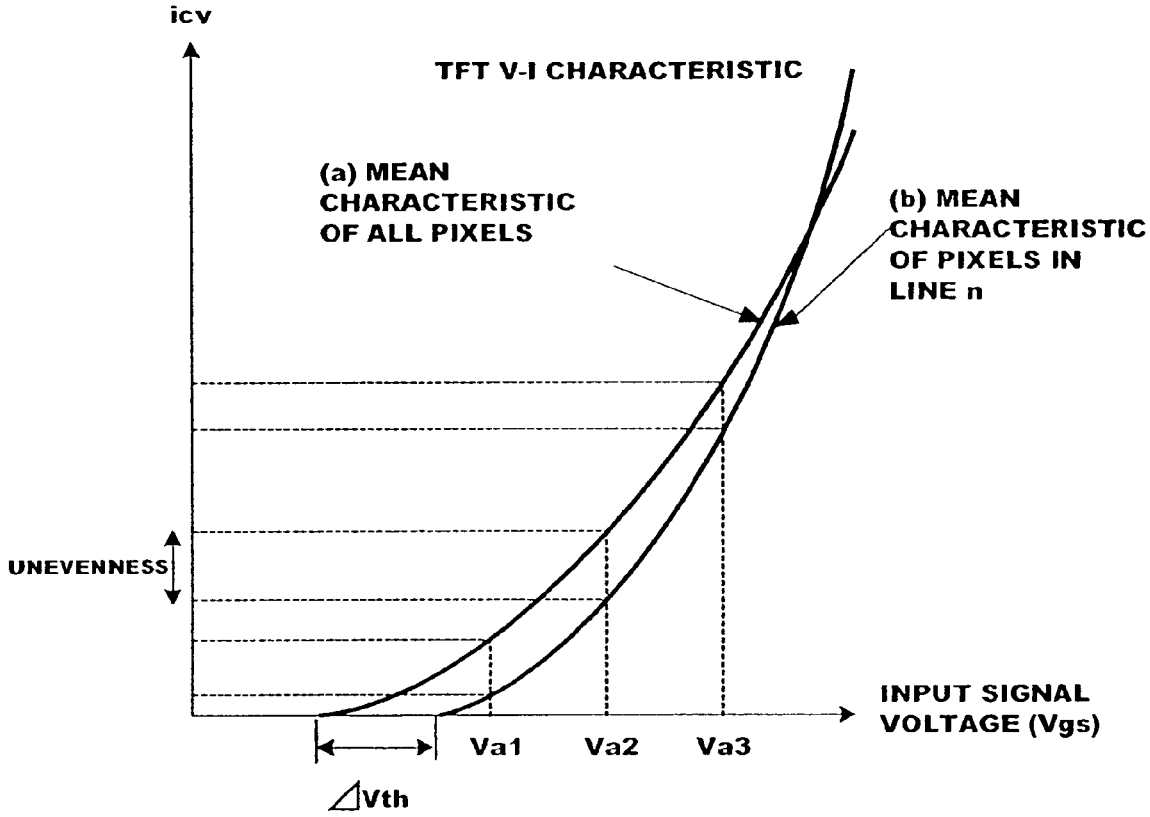
FIG. 3 is a view showing the relationship of brightness and the current icv flowing into the organic EL element with respect to the gate-source voltage Vgs of the drive TFT in all lines and one line.
Figure 5:
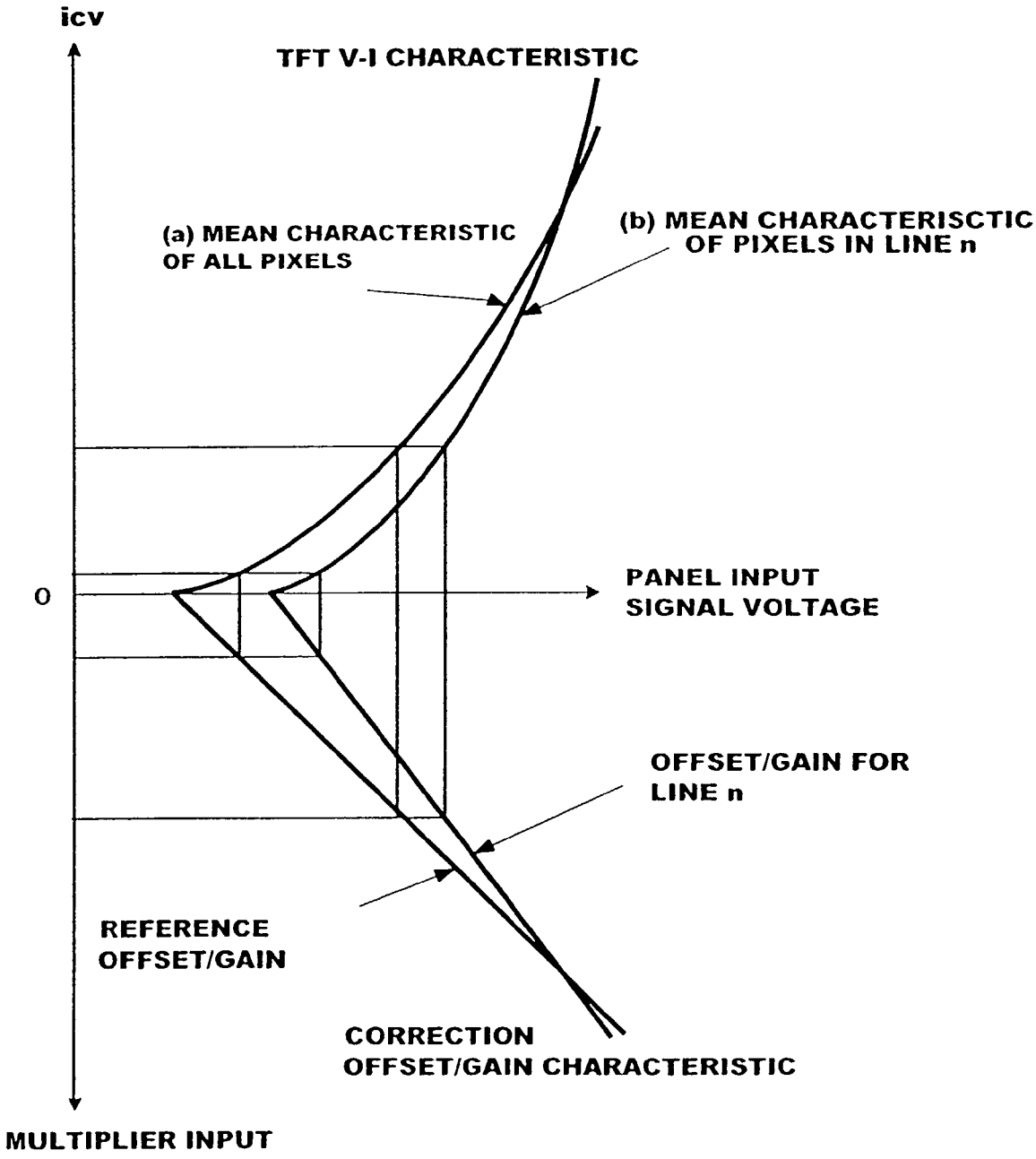
FIG. 5 is a view showing correction of the current icv flowing into the organic EL element with respect to the gate-source voltage Vgs of the drive TFT.

Plot the input voltage vs icv relationship since the mean current of all pixels (icv) is obtained by dividing the CV current by the total number of pixels. From this result, estimate and plot the mean TFT V-I characteristic of this panel ((a) in FIG. 3).

ii) Light up only an arbitrary horizontal line in the panel with two or more input voltages (three points, namely, Va1, Va2 and Va3 in FIG. 3 in this example) and measure the CV current at each input voltage. Estimate and plot the TFT V-I characteristic of one pixel in this line since the mean current of all pixels (icv) in this line is obtained by dividing the CV current by the number of all pixels in one line ((b) in FIG. 3). Similarly, estimate and plot the TFT V-I characteristic of all lines. These line-by-line V-I characteristics allow for determination of approximation equation, etc. in the same manner as with the aforementioned V-I characteristic of all pixels.

iii) From FIG. 3, find deviations in Vth and gm in line n from the mean characteristic and find a correction gain and offset such that the difference in CV current or brightness becomes minimal. That is, it suffices to find a correction gain that compensates for the characteristic in FIG. 3 as shown in FIG. 5. In this example, the correction offset/gain characteristic is approximated by straight lines. Therefore, correction offset is the difference between the panel input signal voltage at icv=0 for the reference offset/gain and the panel input signal voltage at icv=0 for the offset/gain in a specific line. Correction gain is obtained by dividing the offset/gain slope in a specific line by the reference offset/gain slope.

iv) Store the correction gain and offset thus obtained in the memories 26 and 32. This allows for incoming brightness data (R data, G data, B data) to be multiplied by the correction gain using the multipliers 22 (22R, 22G, 22B) and added to the correction offset by the adders 28 (28R, 28G, 28B) for brightness data correction. Therefore, each item of brightness data is corrected properly in accordance with the characteristic (offset, V-I characteristic) of the TFT to be driven, converting the data to an analog signal and supplying the signal to the display panel 10. As a result, a current responsive to the brightness data is supplied to the corresponding organic EL element, ensuring light emission in line with brightness data.

Thus, it is possible to correct, through simple measurement and relatively simple external circuitry, brightness non-uniformity occurring in organic EL display elements as a result of change of the drive TFT characteristic due to manufacturing problems.

Here, the display panel 10 is normally formed on a glass substrate, with pixel circuits arranged in a matrix form in the display area and drive circuits arranged therearound. Pixel circuits are formed, for example, by forming TFTs and circuitry on a glass substrate using a technique for forming a normal semiconductor IC. Then, pixel electrodes such as ITO are formed, with an organic layer and cathode stacked on top thereof.

When a display panel is thus manufactured, a power supply is connected and the total current Icv flowing through organic EL elements is measured. That is, the supply voltage PVdd is supplied to each of the power lines PVdd of the display panel 10, thus measuring the total current Icv flowing from the common cathode of all organic EL elements to the power supply CV with a current detector. Then, correction values are prepared as described above from the obtained detection result.

Figure 6:
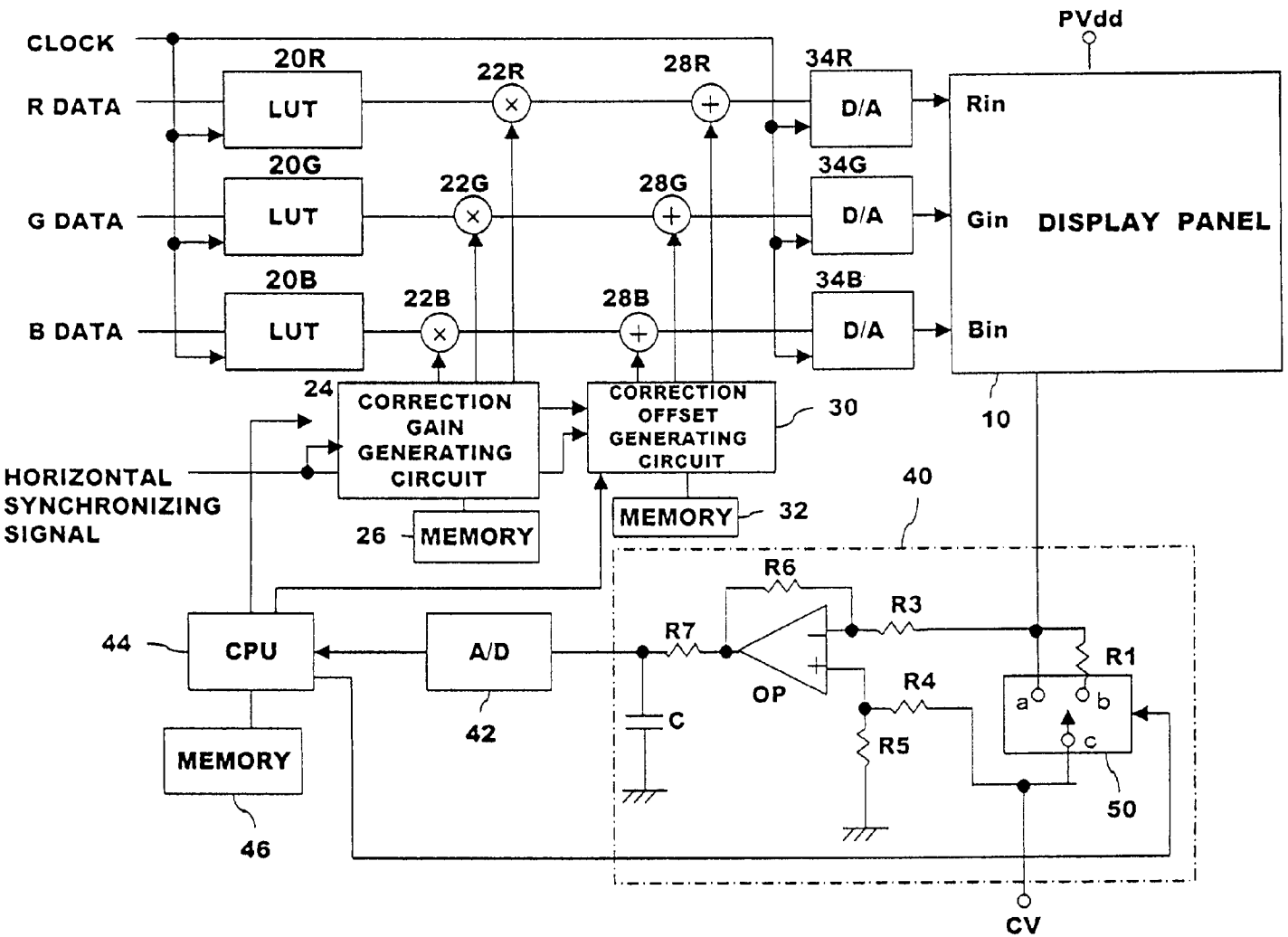
FIG. 6 is a block diagram showing the configuration of the EL display apparatus including the configuration for calculating a correction calculation equation and correction values.

FIG. 6 shows a configuration example incorporating a circuit handling the aforementioned correction in the product itself. In this configuration, the display panel 10 is connected to the power supply PVdd on the positive side and to the low-voltage power supply CV on the negative side as with FIG. 4, with a current detector 40 provided between the display panel 10 and the low-voltage power supply CV.

Then, the detected value of the current detector 40 is first converted to digital data by an A/D converter 42 and then supplied to a CPU 44. The CPU 44, a microcomputer controlling various operations of the organic EL display apparatus, is connected to a memory 46 for storing necessary data as appropriate and also performs processing, described in the aforementioned embodiment, for controlling offset responsive to the detected value of the current detector 40.

Next, the configuration of the current detector 40 in the figure will be described. The negative side of the display panel 10 is fed to a switch 50. The switch 50 has an output side terminal c connected to the low-voltage power supply CV and one of other two input side terminals a and b selectively connected to the power supply CV. The switching of the switch 50 is controlled by the CPU 44. While the negative side of the display panel 10 is connected to the two input terminals a and b, the terminal a is connected as is and the terminal b is connected via a resistor R1 to the switch 50.

The CPU 44 selects the input terminal a under normal conditions and the input terminal b to perform processing for correction. This almost completely eliminates the voltage drop at the current detector 40 under normal conditions. When the input terminal b is selected, a voltage drop according to the CV current occurs in the resistor R1, bringing the voltage on the upper side of the R1 in line with the CV current.

The upper side of the resistor R1 (side connected to the display panel 10) is connected to the negative input terminal of an opamp OP via a resistor 3. The positive input terminal of the opamp OP is connected to the low-voltage power supply CV via a resistor R4 and to ground via a resistor R5. Therefore, the positive input terminal of the opamp OP is maintained at the voltage determined by ground, the CV voltage and the resistors R4 and R5. On the other hand, the negative input terminal and output terminal of the opamp OP are connected together by a feedback resistor R6. For this reason, the opamp OP produces an output obtained by amplifying the upper side voltage of the resistor R1 by the amplification factor determined by the resistors R3 and R6 with reference to the voltage at its positive input terminal.

The output terminal of the opamp OP is connected to one end of a resistor R7 whose other end is connected to the A/D converter 42 and to ground via a capacitor C. This results in smoothing of the opamp OP output by an integrating circuit consisting of the resistor R7 and the capacitor C, feeding the smoothed voltage to the A/D converter 42.

Thus, selection of the input terminal b by operating the switch 50 allows the current value of the display panel 10 to be loaded into the CPU 44 in the present embodiment.

The CPU 44 operates the switch 50 at appropriate times to detect the amount of current flowing into the display panel 10. For instance, the CPU 44 performs the current detection operation at the time of power-on, initial use of the product, reset and so on. That is, the CPU 44 selects the input terminal b with the switch 50, in this state lights up the entire display panel 10 twice or more, and then successively lights up each line twice or more, thus detecting the mean pixel-by-pixel amount of current for the entire display panel 10 and the mean pixel-by-pixel amount of current for each line. At this time, it is preferable that the current detection resistance value for lighting up the entire panel be changed from that for lighting up one line alone to ensure more accurate measurement. Then, the CPU 44 calculates line-by-line correction gain and offset according to the detected amounts of current and stores these values in the memories 26 and 32.

It is to be noted that correction values may be not only line-by-line gain and offset correction values but also a correction equation regarding the entire tendency of the display panel 10 as described above. Such a correction equation can be obtained by detecting the CV current within a given small area in the display area (one of the areas into which the display area is divided and may be part of that area) and calculating, based on the detected current, an equation of the plane prescribing correction values for the entire display area. It is possible to perform proper correction as with the above embodiment by storing such a correction equation or its factors in the memories 26 and 32. It is to be noted that no problems arise during normal use if the input terminal a is selected by the switch 50 as described above.

Thus, according to the embodiment in FIG. 6, the configuration is provided within the product for detecting correction gain and offset amounts. This makes it possible in actual use of the product to determine and store a correction value calculation equation or correction values as appropriate. Making such settings as appropriate allows addressing of changes in usage conditions and changes over time.

Others i) A typical TFT V-I characteristic may be found and used instead of finding the mean V-I characteristic of all pixels. That is, find a reference V-I characteristic by lighting up a certain area or line and dividing the CV current by the number of pixels.

ii) While the multipliers were used in the above embodiment, lookup tables may be used instead of the multipliers.

That is, if calculations using the multipliers (linear calculations) alone do not provide sufficient correction, it is possible to select an optimal lookup table for each line by making available a number of lookup tables having a non-linear input/output characteristic. In this case, the numbers of the lookup tables to be selected in correspondence with lines are, for example, stored in the memories.

iii) The multipliers 22, the adders 28 and so on in FIG. 4 may be placed before the LUTs. Alternatively, such processing may be handled in an analog manner after the outputs of the D/A converters 34.

iv) Brightness may be actually measured instead of estimating brightness non-uniformity by measuring the CV current.

v) It is beneficial in advance, at the time of panel shipment, to write correction gain and offset to a non-volatile memory on the glass substrate of the organic EL panel or on the flexible cable pulled out from the panel. This allows the circuit on the apparatus side for supplying brightness signal to the display panel 10 to correct input signal (brightness data) based on this data. As a result, the apparatus side can read data from the non-volatile memory on the panel module when the display panel 10 is changed, thus allowing correction of brightness data.

vi) Other data specific to the display panel 10 may be written to the non-volatile memory, such as gamma data, position information of lit and unlit defects and luminous and dark dots and lightness. This allows the apparatus side to control the display using these items of data.

vii) If an equation representing the relationship between pixel positions and correction values is stored, while it is preferred to use a plane equation, a curve equation may be also be used. For example, a high-order polynomial may be used with x and y as variables.

viii) $\Delta Vth$ can be measured by regarding the input voltage at the point where the CV current begins to flow as Vth. Further, brightness may be actually measured instead of estimating brightness non-uniformity by measuring the CV current.

While illustrative and presently preferred embodiments of the present invention have been described in detail herein, it is to be understood that the inventive concepts may be otherwise variously embodied and employed and that the appended claims are intended to be construed to include such variations except insofar as limited by the prior art.

PARTS LIST

10 display panel
20 lookup table
20R lookup table
20G lookup table
20B lookup table
22R multiplier
22G multiplier
22B multiplier
24 correction gain generating unit
26 memory
28R adder
28G adder
28B adder
30 correction offset generating circuit
32 memory
34R converter
34G converter
34B converter
40 current detector
42 A/D converter
44 CPU
46 memory
50 switch.

The invention claimed is:

1. An organic EL display apparatus including in each display pixel an organic EL element and a drive transistor that supplies the organic EL element with a drive current that depends on brightness data and having the display pixels arranged in a matrix form, the organic EL display apparatus comprising:

a correction gain storage unit for storing display pixel positions and a correction gain for correcting the slope of the brightness-data-based drive current of the drive transistors in the display pixels; and a correction unit for correcting pixel-by-pixel brightness data depending on the pixel position using the correction gain stored in the correction gain storage unit into brightness data for the pixel to generate corrected brightness data, wherein each of the display pixels is displayed by driving its drive transistor in response to the data generated by the correction gain storage unit and the correction unit and supplying the corresponding organic EL element with the drive current; and a correction offset storage unit for storing a display pixel position and a correction offset for correcting an offset for brightness data of the drive transistor in the display pixel for an area having a given plurality of display pixels, wherein the correction unit corrects pixel-by-pixel brightness data depending on the pixel position using the correction gain stored in the correction gain storage unit and the correction offset stored in the correction offset storage unit into brightness data for the pixel to generate corrected brightness data.

2. The organic EL display apparatus according to claim 1, wherein the correction unit multiplies brightness data by a correction gain.

3. The organic EL display apparatus according to claim 1, wherein the correction unit adds the correction offset to or subtracts the offset from the brightness data.

4. The organic EL display apparatus according to claim 1, wherein the correction gain storage unit stores a correction value for each of horizontal or vertical lines.

5. The organic EL display apparatus according to claim 1, further including:

overall emission control means for allowing all display pixels in a display area, in which the display pixels are arranged in a matrix form, to emit light based on two or more items of brightness data different from one another;

selective emission control means for permitting organic EL elements of a plurality of display pixels within the given area in the display area to selectively emit light based on two or more pieces of brightness data different from one another;

current detection means for detecting individual drive currents when all and selected pixels emit light; and slope characteristic calculation means for calculating, in relation to a slope of drive current with respect to brightness data in a display pixel selected based on the detected drive current, the relationship of the slope of the drive current with respect to the brightness data for all display pixels, wherein a correction gain corresponding to a slope characteristic calculated by the slope characteristic calculation means is stored in the correction gain storage unit.

6. The organic EL display apparatus according to claim 5, further including:

offset characteristic calculation means for calculating, in relation to a drive current offset with respect to brightness data in a display pixel selected based on the detected drive current, the relationship of the drive current offset with respect to the brightness data for all display pixels, wherein a correction offset corresponding to an offset characteristic calculated by the offset characteristic calculation means is stored in the correction offset storage unit.

* * * * *